US006386026B1

(12) United States Patent
Zamfes

(10) Patent No.: US 6,386,026 B1
(45) Date of Patent: May 14, 2002

(54) CUTTINGS SAMPLE CATCHER AND METHOD OF USE

(76) Inventor: Konstandinos S. Zamfes, 1830-10$^{th}$ Avenue, S.W., Calgary, Alberta (CA), T3C 0J8

( * ) Notice: Subject to any disclaimer, the term of this patent is extended or adjusted under 35 U.S.C. 154(b) by 0 days.

(21) Appl. No.: 09/709,358

(22) Filed: Nov. 13, 2000

(51) Int. Cl.$^{7}$ ..... E21B 47/00; E21B 25/16; G01V 1/00

(52) U.S. Cl. ..... 73/152.04; 175/44; 367/33

(58) Field of Search ..... 73/152.03, 152.04, 73/152.11, 152.18, 152.21, 152.45, 863.12; 175/27, 44, 48, 50, 70, 320; 367/33, 69

(56) References Cited

U.S. PATENT DOCUMENTS 2,266,586 A * 12/1941 Branum ..... 73/863.12
3,530,710 A * 9/1970 Beloglazov et al. ..... 73/152.04
3,563,255 A * 2/1971 Morris ..... 134/133
3,786,878 A * 1/1974 Chapman ..... 175/320
3,872,932 A * 3/1975 Gosselin ..... 173/1
3,899,926 A * 8/1975 Haden ..... 73/152.04
3,982,432 A * 9/1976 Hammond ..... 73/152.45
4,208,285 A * 6/1980 Sample, Jr. ..... 210/180
4,298,572 A * 11/1981 Moffet et al. ..... 422/82.01
4,635,735 A * 1/1987 Crownover ..... 175/48
4,697,650 A * 10/1987 Fontenot ..... 175/50
4,739,655 A * 4/1988 Greer et al. ..... 73/152.03
4,860,836 A * 8/1989 Gunther ..... 175/44
4,878,382 A * 11/1989 Jones et al. ..... 73/152.04
5,165,275 A * 11/1992 Donovan ..... 73/152.04
5,181,419 A * 1/1993 Thompson ..... 73/152.21
5,234,577 A * 8/1993 Van Slyke ..... 208/13
5,237,539 A * 8/1993 Selman ..... 367/69
5,241,859 A * 9/1993 Smith ..... 73/152.18
5,511,037 A * 4/1996 Randall et al. ..... 367/33
5,571,962 A * 11/1996 Georgi et al. ..... 73/152.04
5,866,814 A * 2/1999 Jones et al. ..... 73/152.11
6,026,912 A * 2/2000 King et al. ..... 175/27
6,039,128 A * 3/2000 Brunato ..... 175/70

* cited by examiner

*Primary Examiner*—Hezron Williams
*Assistant Examiner*—Jay L. Politzer
(74) *Attorney, Agent, or Firm*—Sean W. Goodwin

(57) ABSTRACT

A sample catcher comprises an inclined sampling screw conveyor which intercepts a continuous stream of drill cuttings from a shaker. A vaned metering rotor accepts a plurality of discrete samples from adjacent the conveyor's discharge. The vaned rotor is rotated at a lag rate proportional to the rate of penetration at the time the stream of cuttings with drilled. The plurality of discrete samples are discharged as a substantially continuous sample stream which is directed through a second conveyor to one or more analytical instruments. Further, the sample stream can be directed to a sample bag carousel which is index advanced for associating the bag contents with the drilling. The apparatus enables a method of analyzing cutting samples which correlate to the cuttings when drilled and in a process which is continuous.

16 Claims, 5 Drawing Sheets

CUTTINGS SAMPLE CATCHER AND METHOD OF USE

FIELD OF THE INVENTION

The invention relates to apparatus and process for obtaining samples of drilling cuttings from active mud systems, specifically that which permits a representative sample to be collected and subjected to continuous quantitative analysis.

BACKGROUND OF THE INVENTION

During the drilling of a well, mud is circulated downhole to carry away drill cuttings. The cuttings are a view into the characteristics of the drilled strata. In an active mud system, the mud is circulated in a loop; pumped from the mud tank, downhole to the drilling bit, up the annulus to the surface, and back to the mud tank for separation of cuttings, and separation of fine solids in tanks, reconstitution of mud ingredients and reuse. Conventionally, in the first step of separation, before returning to the mud tank, the cuttings are passed over an inclined shaker for separating the largest cuttings from the mud which falls through screens to a tank therebelow. The cuttings are sampled and discarded in a sump. The sampling of the cuttings enables the driller to review the strata being drilled.

The cuttings obtained at the surface must be associated with the strata being drilled. Cuttings cannot be directly related to the actual position of the drilling bit due to the lag associated with the return of the mud from the bit to the surface. This association is obtained using a variety of techniques, the simplest being to correlate the flow rate of mud, the volume of the well bore, mud circulation system and the bit position. Other methods which assist in minimizing inherent inaccuracies with cross-strata blending and the like include matching downhole gamma ray emissions with that measured from cuttings.

Simply, the objective is to obtain samples for analyzing the cuttings in a sequential manner, indexed to the drilling.

Conventionally, some of the cuttings are sampled in some manner or another. Analyses include batch storage of sample in collection tubes, removed manually and analyzed after the fact. Alternatively or in combination, cuttings are stored in small cotton sample bags for storage or later analysis.

One long-time applied method of capturing cuttings includes directing cuttings from the discharge of the shaker and over a plate. The plate has a plurality of holes in it and has converging side walls which funnel the cuttings across the plate. Some of the cuttings pass through the holes and fall into a bucket under the plate. While the intent is to obtain a representative sample, the slip stream approach and stratification of the flow over the plate results in a sample that is less than representative of the entire cuttings population.

Further, the resulting sample, collected in a bucket provides the means for merely an overall qualitative analysis, not a discrete quantitative analysis relative to indexed depths within the wellbore. Accurate assessment of the formation strata is not possible with large, indiscrete sampling. As the sample buckets are only emptied periodically, they may fill to overflowing allowing valuable sample to be lost. The introduction of fluids, such as heavy rains or waves in offshore drilling may cause cuttings to be washed out of the sample collecting bucket resulting in the irretrievable loss of geological data.

Dissatisfaction with errors arising from the simple past methods has caused others to attempt more comprehensive systems of sampling an U.S. Pat. No. 5,571,962 to Georgi et al., it is recognized that certain errors in associating collected cuttings to the strata being drilled. Accordingly, Georgi suggest measuring gamma ray emissions in collected cuttings and comparing them with well drilling logs of same. Georgi provides a continuous sample collection apparatus in which cutting samples are routed by an auxiliary mud pump through a flow line to a mini-shaker connected to an inclined shale shaker. The mini-shaker has assemblies of varying mesh sizes so as to separate the cutting based on particle size. The cuttings are subsequently washed with fluid to remove fine particles which flow out of the top of a settling pipe. The larger, more dense cuttings settle to the bottom by gravity and are collected in transparent storage vessels which permit qualitative inspection, examination for gamma ray emissions and for employing ultraviolet fluorescent techniques. Georgi anticipates further automating the process using mechanical carousels to rotate the collection vessels and means to collect simultaneous duplicate samplings for future analysis.

Like the older sloped and perforated plate technique, the screens of Georgi's mini-shaker may not provide a well mixed sample, having performed a further stage of a slip-stream screening separation, risking segregation of the sample including loss of sample and plugging; and while it has been suggested to automate the removal of storage vessels, there is not disclosed apparatus for doing same or for determining when they should be changed out or how to associate them with the drilling.

Other sample collectors, such as that described in U.S. Pat. No. 4,718,289 to Barrett collect only and do not send sample for analysis. In this case of buckets the sample collection devices must be removed from the stream of cuttings by the operator and are therefore very subjective with regards to sampling frequency.

U.S. Pat. No. 4,287,761 to Moffat et al. describes a flow chamber which allows for the continuous analysis of drilling mud using visual scrutiny through sight glasses and a hydrocarbon sensor mounted in the continuous flow chamber. Discrete samples are not retained for any future analysis.

SUMMARY OF THE INVENTION

Method and sample catcher apparatus are provided for obtaining a representative sample of cuttings, and for selecting representative sub-samples for storage and analysis. In one embodiment, the apparatus comprises an inclined sampling screw conveyor which intercepts the entire drill cuttings flow from a shaker and a vaned metering rotor which accepts a fixed volume of sub-sample from the discharge of the sampling screw conveyor, wherein the rate of extraction is less than the continuous stream of drill cuttings, and directs it to one of, or both of, a series of analytical instruments or a indexed carousel of sample bags. The rate of penetration (ROP) and the recirculation rate of mud is determined so as to establish a lag ROP, being the ROP as it was at the time the drill cuttings were drilled. The carousel is controlled to index advance for properly associating the bag contents with the drilling. The apparatus further comprises an analytical conveyor for directing at least a portion of the sample stream past one or more analytical devices. The conveyor is transparent to the particular emission characteristics of the instrument. Further, it is preferred that the analyzed sub-sub-sample is discharged from the analytical screw into a transparent cylinder for visual and qualitative analysis. A carousel can also be provided for associating the transparent cylinder contents with the drilling.

The apparatus enables a novel process for obtaining and analyzing cuttings from a shale shaker comprising receiving the whole shaker discharge of cuttings, conveying and mixing the whole cuttings in a sampling screw conveyor and discharging the bulk to waste. A plurality of discrete, metered and representative volume samples of cuttings are extracted from adjacent the discharge of the sampling conveyor with the vaned metering rotor. Discrete samples are obtained at a rate which is proportional to the lag ROP. The sample is discharged as a substantially continuous sample stream or as sub-sample streams to the analytical instruments or into a series of sample bags which are successively filled, advanced and replaced in a manner dictated by the rate of drilling. The sampling conveyor is advanced sufficiently quickly to ensure the whole flow is accommodated, yet slow enough to properly mix a representative sample. The advance rate of the sampling conveyor can also be linked to Lag ROP, as is the metering rotor, and the sample bag carousel. The sample bags are further tracked and identified according to the drilling depth, associated by drilling rate and mud lag.

More preferably, the process for analyzing cuttings is further enhanced by selecting a portion of the sample stream and directing it past a series of quantitative analyses which are conducted through the emission transparent wall of the analytical conveyor, such analyses including gamma emission rate, nuclear density, laser reflection spectrometry, fluorescence and sonic testing. The present method permits the sample to be analyzed prior to discharging to the sample bags. Even more preferably is to direct the sample, once passed by the analytical instrument into a vertical transparent container for further visual and qualitative analysis.

DETAILED DESCRIPTION OF THE PREFERRED EMBODIMENT

Figure 1:
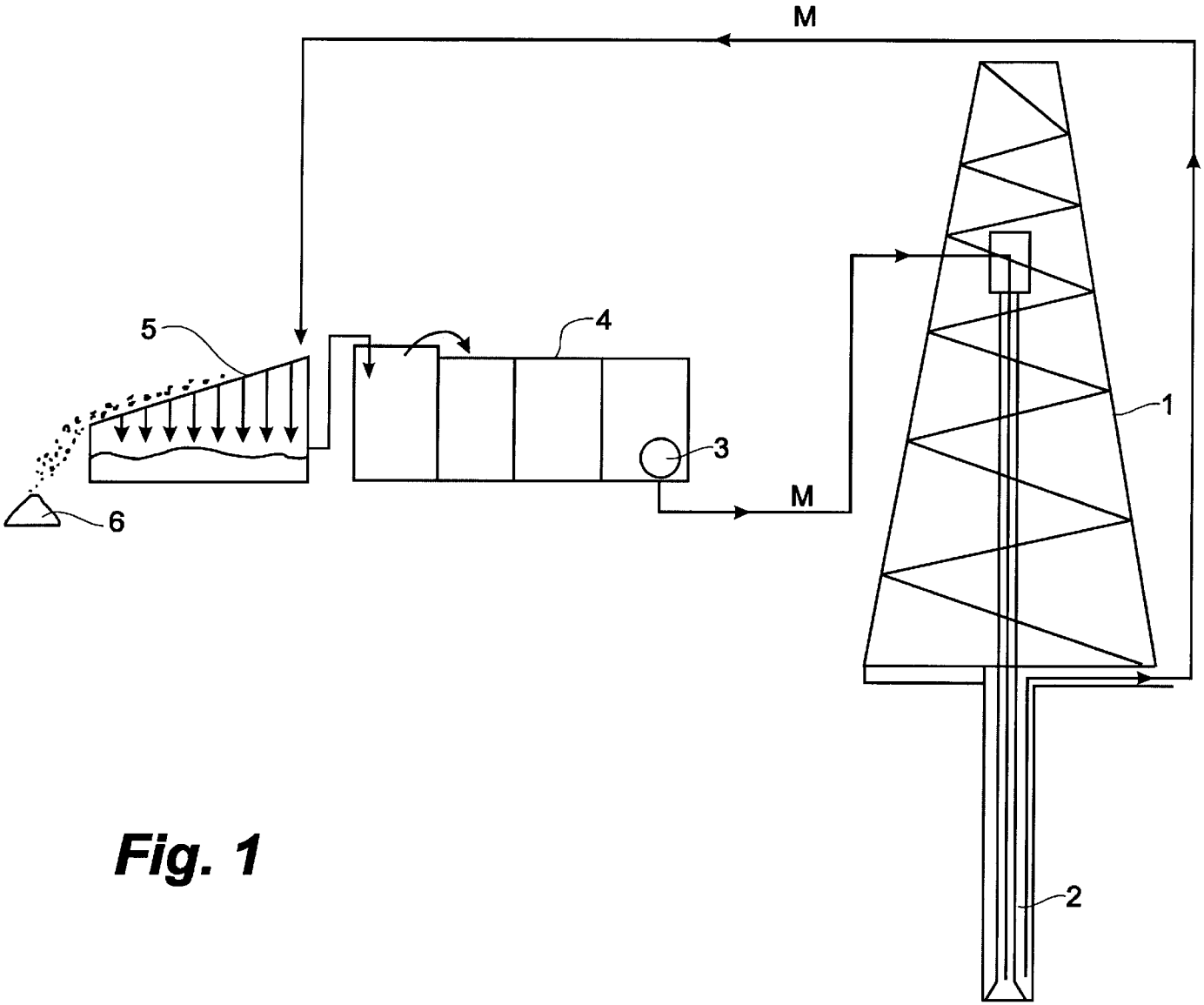
FIG. 1 is a schematic of an active mud system.

Having reference to FIG. 1, a drilling rig 1 drills a well 2 through various subterranean strata in the earth. Mud M is used to aid in drilling and conveying cuttings from the well 2 to the surface. Mud M is delivered in a closed loop system comprising a mud pump 3 which circulates mud M to the drilling bit in the well 2, up the annulus of the well and back to a mud tank 4 for separating cuttings from returning mud M. A shale shaker 5 intercepts the mud M for separating the greatest portion of the cuttings 6 for disposal, before returning the mud M for reconstitution and routing to the mud pump 3 for reuse.

Figure 2:
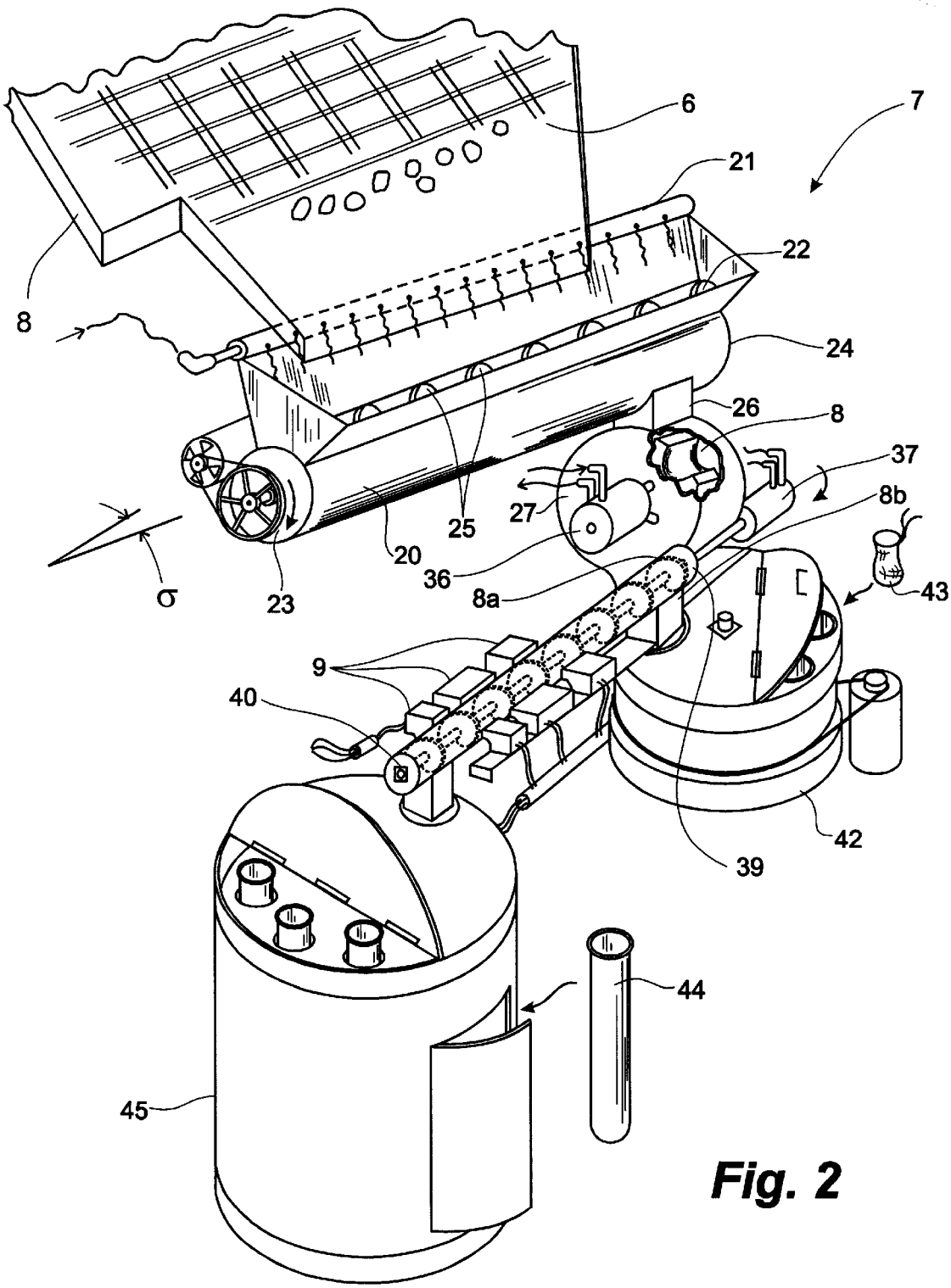
FIG. 2 is a perspective view of an implementation of the present invention.

Having reference to FIG. 2, the cuttings 6 are collected from the shale shaker 5 and processed through a sample catcher 7 for first obtaining a representative sample 8 of cuttings 6. A metering device delivers a sub-sample 8*a* of the representative sample 8 to a transparent analytical screw for performing a series of quantitative analysis 9, as a first sub-sample stream. The remainder of overflow sample 8*b* from the metering device is directed for collection in sample bags 43, typically one bag per 5 meters drilled, as a second sub-sample stream. Once the quantitative analysis is complete, the sub-sample 8*a* is directed into transparent cylinders 44 for visual inspection and qualitative analysis.

Figure 3:
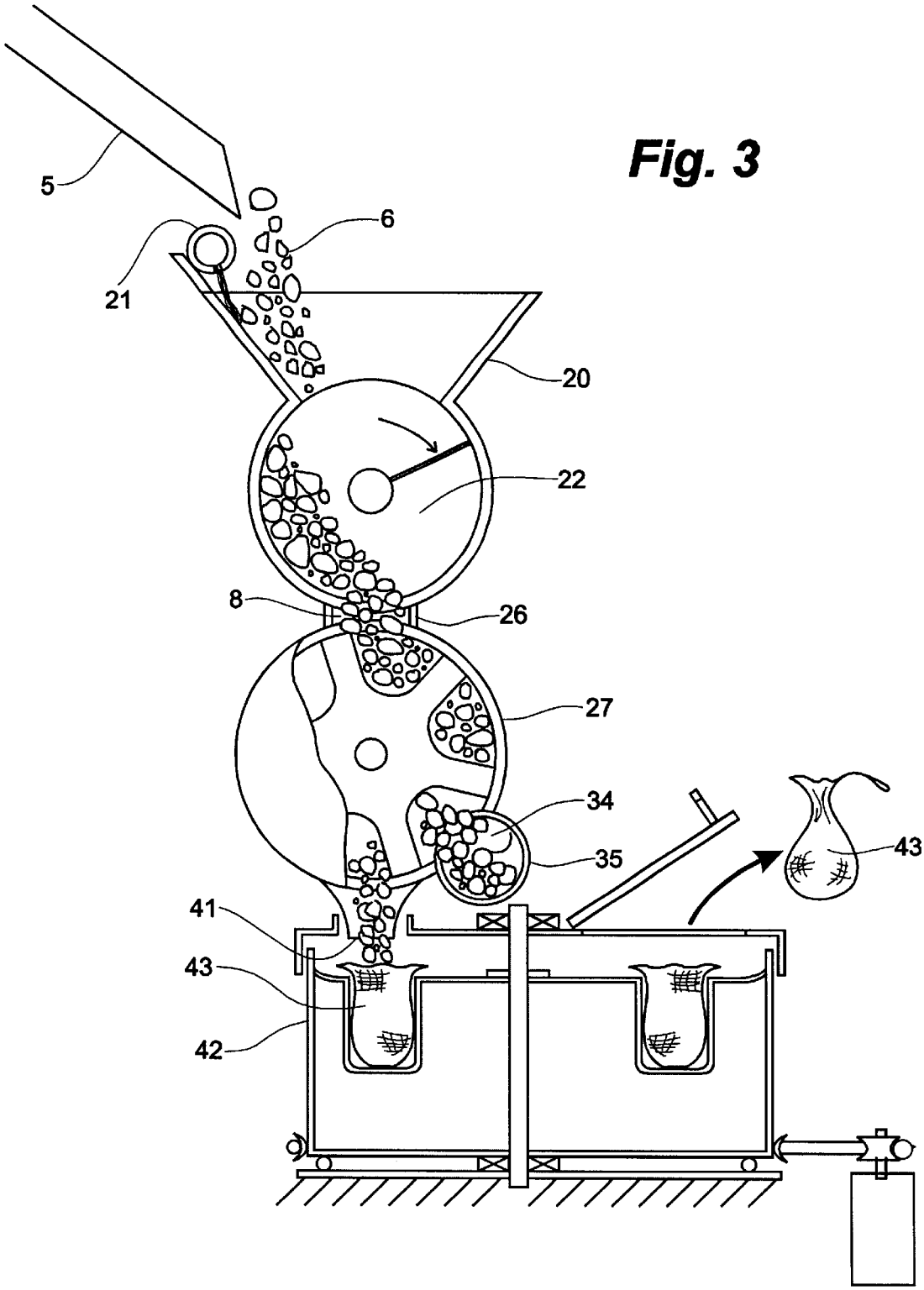
FIG. 3*a* is a partial cross-sectional end view of the shaker discharge and cuttings flowing into the sample catcher according to FIG. 2.
FIG. 3*b* is a cross-sectional view of the metering device rotor.
Figure 4:
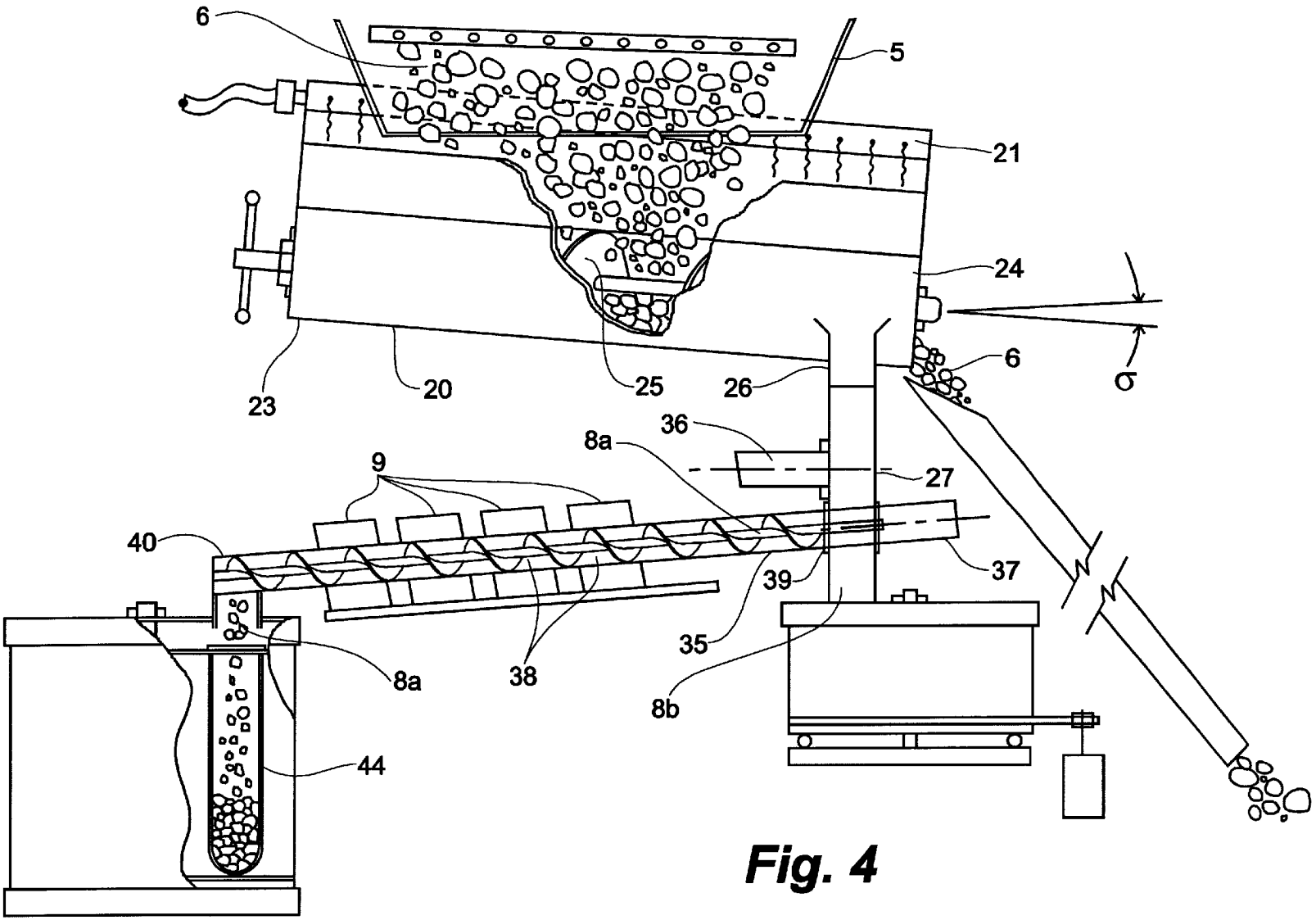
FIG. 4 is a front, partially cutaway view of the sample catcher of FIG. 3.

More specifically, as shown in FIGS. 2–4, a continuous stream of cuttings 6, separated from the drilling mud by the shaker 5, are collected in a trough 20 at the outlet of the shaker 5. A liquid wash header 21 extends along the underside trough wall for ensuring all the cuttings are washed into a first screw 22, positioned at the base of the trough 20, and collected. Usually water is used, however other liquids can be used in cold conditions or with invert muds, diesel is used.

The first screw 22 is inclined from a first end 23 to a second or discharge end 24 for assisting in moving the collected steam of cuttings to the discharge end of the screw 24. Helical flights 25 collect cuttings 6 from across the entire outlet of the shaker 5, mix the cuttings 6 and move them from the first end 23, and intermediate the first 23 and second ends 24 of the trough 20, to the second end 24 of the trough 20. A small sample outlet 26 is positioned in the bottom of the first screw 22 adjacent its second end 24. Flexible helical flights 25 ensure that occasional foreign articles do not jam the first screw 22. A representative sample 8 of the stream of cuttings 6 discharge through the sample outlet 26. The majority and balance of the cuttings discharge from the end of the first screw 22 as waste 6 for collection and routing to a sump or other storage (not shown) in a conventional manner.

A vane-type dosing or metering device 27 is positioned beneath the sample outlet 26. The metering device 27 only collects a plurality of small, discrete representative samples 8 of predetermined volume forcing the first screw 22 to carry the remainder of the cuttings 6 away as waste. Thus, the rate at which the substantially continuous stream of discrete samples is extracted is less than the rate of the continuous stream of drill cuttings.

Figure 5A:
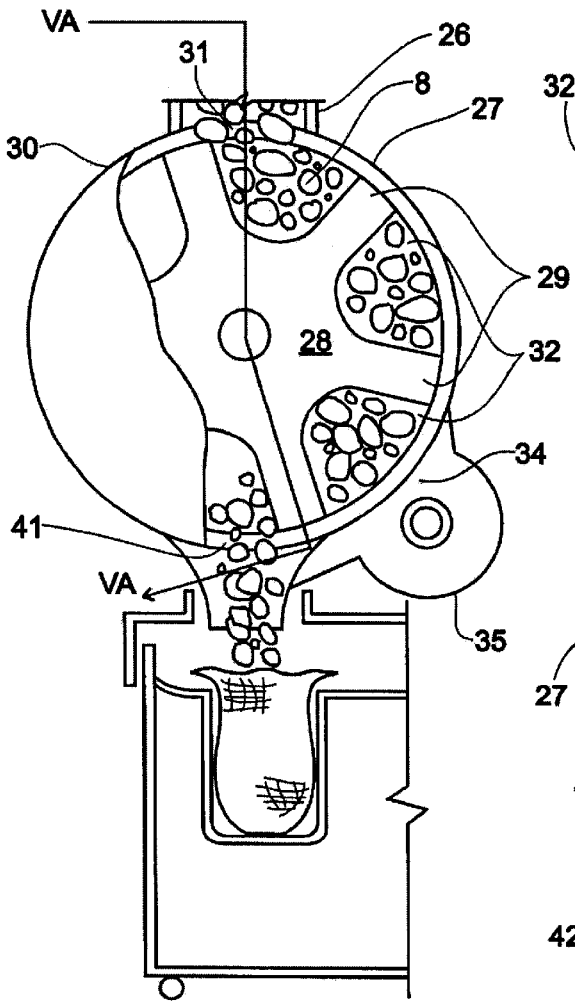
FIG. 5*a* is a partial cutaway side view of an embodiment utilizing parallel rotors.
Figure 5B:
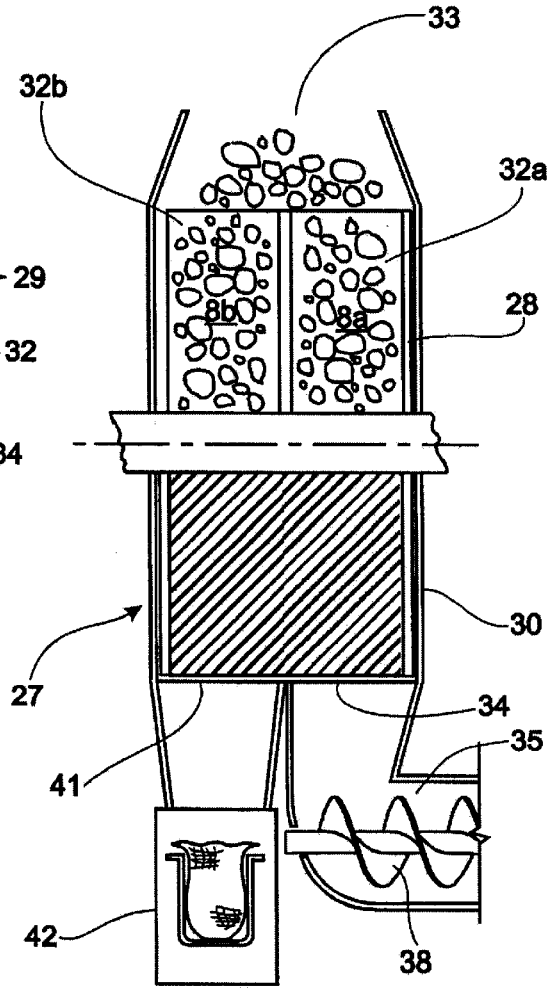
FIG. 5*b* is a partial cross sectional view of the parallel rotor arrangement of FIG. 5*a* along lines Va—Va.

As shown in FIGS. 3, 5*a* and 5*b* the metering device 27 comprises a rotor 28 having a plurality of flexible radial vanes 29, all rotating within in a housing 30. A variable speed motor 36 (FIG. 2) drives the rotor 28. The sample outlet 26 is connected to an inlet port 31 in the housing 30. When the metering device 27 rotates the rotor past the inlet port 31, the cuttings sample 8 falls into and fills the spaces or chambers 32 between the vanes 29. With a single rotor, two outlet ports 34 and 41 are provided with are circumferentially and serially positioned.

Having reference to FIG. 3*b*, another embodiment of the rotor 28 contains a disc 33 placed in a plane perpendicular to the rotational axis, effectively dividing the rotor into parallel rotors and dividing each of the chambers 32 between the vanes 29 into two separate compartments 32*a*, 32*b*. The sample 8 is rotated in the compartments 32*a*, 32*b* until it reaches a first outlet port 34 where a subset sample 8*a* is discharged.

The sub-sample 8*a* discharges into a second sample conveyor 35 forming the first sub-sample stream. The first outlet port 34 is aligned with the second conveyor 35 to deliver only sample contained in one compartment 32*a* of the space 32 between the vanes 29 of the metering device 27. The second conveyor 35 is transparent to one or more quantitative analysis emissions such as light, as required for UV and fluorescence instruments, and radioactivity for gamma and nuclear density instruments. The conveyor drives the sub-sample 8*a* or a series of transparent cuvettes (not shown) can collect the sub-sample 8*a* and are carried on the conveyor 35 which is advanced away from the metering device 27 using a stepper motor 37. The sub-sample 8*a* is then moved, by the conveyor 35 into position for discrete spectrophotometric and radioactive analysis. Alternatively, as shown, where the second conveyor 35 is a screw conveyor, the helical flights 38 are also selectively transparent and advance the sub-sample 8*a* from a first end 39 of the second conveyor 35 to a second discharge end 40.

Sample 8, contained in compartment 32*b*, which is not accepted by the second conveyor 35 in the single rotor embodiment or directly in the parallel rotor embodiment continues to be carried as sample 8*b* within compartment 32*b* until it rotates to a second outlet port 41, preferably located at the bottom of the housing 30 and forms the second sub-sample stream. There is no restriction on discharge from the second outlet port 41 and thus the metering device 27 empties through the second outlet port 41.

The remainder of the sample 8*b* falls out of compartment 32*b* and into a collection carousel 42. As shown in FIG. 3, a series of small cotton bags 43 are suspended on a carousel 42 located directly below the second outlet port 41. The movements of the metering device rotor 28 and the carousel 42 are synchronized so that the remaining sample 8*b* falls directly into a bag 43 in which it can be stored for future analysis.

The volume of the vane space 32 and the movement of the carousel 42 is indexed to the lag rate of penetration of drilling (ROP). The bags 43 are pre-labeled to indicate their relationship to the rate of penetration of drilling and lag calculations permit the bag sample to be associated with the drilling depth. The bags pass beneath the second port 41 at predetermined intervals for accepting cuttings 6 which represent cuttings for the particular depth or interval.

The second conveyor 35 conducts the sample 8*a* past one or more quantitative analyses 9 performed on the sample 8*a* including: gamma ray, nuclear density apparatus for determining the density; an ultrasound permeation device for determining the pore volume; color meter, fluorescence, a laser reflection spectrometer and other similar tests.

Once through the second conveyor 35, the sample 8*a* is discharges from the second end 40 into a transparent cylinder 44 for visual, qualitative analysis. Each cylinder 44 can be linked with a drilling depth using the same lag calculations. One or more cylinders 44 are fitted to a core box carousel 45 for automating the collection of cuttings sample 8*a*.

The embodiments of the invention in which an exclusive property or privilege is claimed are defined as follows:

1. A method for analyzing a continuous stream of drill cuttings produced while drilling, the rate of penetration being known over time, comprising the steps of:

receiving the continuous stream of drill cuttings;

mixing the continuous stream of drill cuttings;

continuously determining lag rate of penetration (ROP) for the moment in time the drill cuttings in the continuous stream were drilled;

extracting discrete samples of cuttings from the continuous stream of mixed cuttings at an extraction rate proportional to the lag ROP, the extraction rate being less than the continuous stream of drill cuttings wherein a substantially continuous sample stream of discrete samples is produced; and extracting at least a portion of the substantially continuous sample stream for sample analysis.

2. The cuttings analysis method of claim 1, the extraction of the discrete amount of cuttings further comprising the steps of:

conveying the continuous stream of mixed cuttings past a first sampling point;

repeatedly positioning one or more sampling chambers of known volume at the first sampling point, each receiving the discrete amount of cuttings; and controlling the rate at which the sampling chambers are positioned at the first sampling point so that the sampling stream is proportional to the lag ROP.

3. The cuttings analysis method of claim 2 further comprising the steps of:

extracting a first sub-sample stream of drill cuttings from the sample stream;

directing at least a portion of the first sub-sample stream to one or more quantitative analyzers.

4. The cuttings analysis method of claim 3 further comprising the steps of:

extracting a second sub-sample of drill cuttings from each discrete sample in the substantially continuous sample stream for forming a second sub-sample stream;

directing the second sub-sample stream to one of a plurality of sample containers; and sequentially indexing the sample containers to receive the second sub-samples at a rate proportional to the lag ROP.

5. The cuttings analysis method of claim 3 further comprising the steps of:

conveying the first sub-sample stream of drill cuttings along a second conveyer;

positioning the one or more quantitative analyzers along the second conveyor and subjecting the first sub-sample stream to analytical emissions and detection, the second conveyor being selectively transparent to said emissions so that the results of the analyses can be correlated to the moment in time the drill cuttings in the continuous sample stream were drilled.

6. The cuttings analysis method of claim 3 wherein the analytical emissions and detection are selected from the group of gamma ray, nuclear density, ultrasound and fluorescence.

7. The cuttings analysis method of claim 4 wherein the second sub-sample stream is extracted from a residual portion of the first sub-sample stream after at least a portion the first sub-sample is directed to the one or more quantitative analyzers.

8. The cuttings analysis method of claim 1 wherein the receiving and mixing of the continuous stream of cuttings further comprises the steps of:

receiving the continuous stream of drill cuttings in a collection conveyor;

mixing the drill cuttings in the collection conveyor;

conveying the drill cuttings to a conveyor discharge; and extracting the discrete amount of cuttings from the mixed cuttings prior to the conveyor discharge.

9. The cuttings analysis method of claim 8 wherein the collection conveyor is a screw conveyor which continuously conveys the drill cuttings on an incline downwardly to its conveyor discharge.

10. Apparatus for analysis of a continuous stream of drill cuttings produced while drilling, the rate of penetration (ROP) being known over time, comprising:

a conveyor for receiving and continuously mixing the continuous stream of drill cuttings and having a outlet for discharging a continuous stream of mixed cuttings;

a first housing having two or more chambers movable therein, the housing having an inlet and an outlet, the first housing's inlet being positioned adjacent the conveyor's outlet, the one or more chambers being periodically aligned with the first housing's inlet to extract a series of discrete samples of mixed cuttings, the extraction rate being less than the continuous stream of mixed cuttings, and the one or more chambers being periodically aligned with the first housing's outlet to discharge the series of discrete samples of cuttings as a substantially continuous sampling stream, the rate of discharge of the sampling stream being proportional to a lag ROP being the ROP at the moment in time the drill cuttings received in the conveyor were drilled; and one or more analytical instruments arranged for analyzing the sample stream.

11. The cuttings analysis apparatus of claim 10 wherein a first conveyor has a discharge end and an open top for receiving substantially all of the continuous stream of drilling cuttings and conveying them to the discharge end, the first housing's housing inlet being positioned adjacent the discharge end of the first conveyor so as to extract the discrete samples.

12. The cuttings analysis apparatus of claim 11 further comprising an analysis conveyor having a second housing and an inlet, the second housing's inlet being positioned at the first housing's housing outlet for receiving a sub-sample of the sample stream, the analysis conveyor conveying the sub-sample continuously to the one or more analytical instruments for analysis.

13. The cuttings analysis apparatus of claim 12 wherein the housing and one or more chambers further comprise:

a rotor positioned rotatably within the first housing, the rotor having a plurality of radial vanes forming circumferentially spaced chambers, the housing having bounding side walls and a circular circumferential wall, the circumferential wall having an upper inlet and one or more lower outlet formed therein;

a variable-speed motor for rotating the rotor; and a controller for instructing the variable-speed motor to rotate the rotor at a rate proportional to the lag ROP.

14. The cuttings analysis apparatus of claim 13 further comprising a second conveyor positioned at one of the first housing's one or more lower outlets for accepting at least a portion of the sample stream wherein the one or more analytical instruments are arranged along the second conveyor, the second conveyor being transparent at each of the one or more analytical instruments to the particular emissions emitted and received thereby.

15. The cuttings analysis apparatus of claim 14 wherein the capacity of the second conveyor is less that the sampling stream, further comprising:

a second lower outlet in the first housing and downstream from one of the lower outlets on the second conveyor;

an indexed sample carousel for incrementally positioning one of a plurality of sample bags under the second lower outlet for receiving that portion of the sampling stream which is not accepted by the sample conveyor, the carousel being indexed sequentially so that each sample bag receives a portion of the sampling stream corresponding to the lag ROP.

16. The cuttings analysis apparatus of claim 12 wherein the housing and one or more chambers further comprise:

two or more parallel rotors positioned rotatably within the first housing, the parallel rotors being separated by one or more panels, each rotor having two or more plurality of radial vanes forming circumferentially spaced chambers, the housing having side walls bounding the two or more parallel rotors and a circular circumferential wall, the circumferential wall having an upper inlet and a lower outlet formed therein;

a variable-speed motor for rotating the rotor; and a controller for instructing the variable-speed motor to rotate the rotor at a rate proportional to the lag ROP;

the second conveyor being positioned at the lower outlet for one of the parallel rotors; and an sample carousel which is incrementally indexed to position one of a plurality of sample bags under the lower outlet for anther of the parallel rotors.

* * * * *